US006808306B2

(12) United States Patent
Weetman

(10) Patent No.: US 6,808,306 B2
(45) Date of Patent: Oct. 26, 2004

(54) MIXING VESSEL APPARATUS AND METHOD

(75) Inventor: Ronald J. Weetman, Rochester, NY (US)

(73) Assignee: SPX Corporation, Charlotte, NC (US)

( * ) Notice: Subject to any disclaimer, the term of this patent is extended or adjusted under 35 U.S.C. 154(b) by 69 days.

(21) Appl. No.: 10/366,483

(22) Filed: Feb. 14, 2003

(65) Prior Publication Data

US 2004/0160856 A1 Aug. 19, 2004

(51) Int. Cl.[7] ..... B01F 3/04

(52) U.S. Cl. ..... 366/302; 366/307; 261/91

(58) Field of Search ..... 366/302, 307, 366/347, 262, 270, 175.2; 261/89, 90, 91, DIG. 71; 239/221, 222.1

(56) References Cited

U.S. PATENT DOCUMENTS

| | | | | | |
|---|---|---|---|---|---|
| 33,262 | A | * | 9/1861 | Mudge | 366/307 |
| 73,479 | A | * | 1/1868 | Wards | 366/307 |
| 706,473 | A | * | 8/1902 | Low | 366/270 |
| 1,181,205 | A | * | 5/1916 | Arnold | 422/228 |
| 1,318,774 | A | * | 10/1919 | Bour | 261/89 |
| 1,765,386 | A | * | 6/1930 | Wait | 366/265 |
| 1,867,824 | A | * | 7/1932 | Hammerly | 366/279 |
| 2,164,944 | A | * | 7/1939 | Rosmait | 366/270 |
| 2,268,219 | A | * | 12/1941 | Lyons et al. | 261/91 |
| 2,391,858 | A | * | 1/1946 | Auer | 366/136 |
| 2,530,814 | A | * | 11/1950 | Becze et al. | 261/93 |
| 2,560,526 | A | * | 7/1951 | Thompson | 261/91 |
| 2,990,302 | A | * | 6/1961 | Bland | 366/291 |
| 3,154,601 | A | * | 10/1964 | Kalinske et al. | 261/93 |
| 3,174,313 | A | * | 3/1965 | Crosby et al. | 68/181 R |
| 3,249,340 | A | * | 5/1966 | Pinto | 366/261 |
| 3,416,729 | A | * | 12/1968 | Ravitts et al. | 239/16 |
| 3,426,899 | A | * | 2/1969 | Smith | 261/DIG. 71 |
| 3,473,790 | A | * | 10/1969 | Auler et al. | 261/91 |
| 3,515,375 | A | * | 6/1970 | Roos | 366/263 |
| 3,560,379 | A | * | 2/1971 | Muskat | 210/738 |
| 3,576,316 | A | * | 4/1971 | Kaelin | 261/91 |
| 3,865,721 | A | * | 2/1975 | Kaelin | 261/91 |
| 3,911,065 | A | * | 10/1975 | Martin et al. | 261/91 |
| 3,936,381 | A | * | 2/1976 | Pacaud | 210/195.1 |
| 3,980,740 | A | * | 9/1976 | Bos | 261/91 |
| 4,102,658 | A | * | 7/1978 | Jarvenpaa | 261/89 |
| 4,145,383 | A | * | 3/1979 | Randall | 261/29 |
| 4,606,648 | A | * | 8/1986 | Coyle et al. | 366/297 |
| 4,628,391 | A | * | 12/1986 | Nyman et al. | 366/265 |
| 4,666,611 | A | * | 5/1987 | Kaelin | 261/91 |
| 4,938,867 | A | * | 7/1990 | Long | 261/122.1 |
| 5,292,194 | A | * | 3/1994 | Gabor | 366/263 |
| 5,782,556 | A | * | 7/1998 | Chu | 366/307 |
| 6,464,384 | B2 | * | 10/2002 | Kubera et al. | 366/102 |
| 6,729,839 | B1 | * | 5/2004 | Illingworth et al. | 415/1 |

* cited by examiner

*Primary Examiner*—Tony G. Soohoo
(74) *Attorney, Agent, or Firm*—Baker & Hostetler LLP

(57) ABSTRACT

An improved mixing apparatus and method for dispersing gas or other fluids into a liquid which may have solid suspension. The improved mixing apparatus includes a mixing vessel having at least one side wall and a bottom wall. The apparatus also has upper and/or lower reflectors attached to the side wall, positioned at an angle to the side wall. The apparatus may additionally include a shaft with a first impeller having a first diameter attached thereto and a second impeller having a second diameter attached thereto. The first impeller and second impeller are positioned a distance apart.

17 Claims, 2 Drawing Sheets

MIXING VESSEL APPARATUS AND METHOD

FIELD OF THE INVENTION

The present invention relates to a mass transfer apparatus and method. More particularly, the present invention relates to an improved and more efficient mixing vessel and impeller arrangement to be employed in liquid aeration processes. The invention is useful, for example, for use in waste treatment plants for introducing oxygen and/or oxygen containing gas into waste water. The invention is also useful in various other mass transfer processes.

BACKGROUND OF THE INVENTION

In mass transfer processes such as waste treatment and bio-reactions, it is common to carry out these processes in a stirred vessel in which gas, such as oxygen or an oxygen containing gas, is introduced into a liquid containing a solid phase and/or micro-organisms therein. These aforementioned processes are oftentimes utilized by municipalities and industry to treat waste wherein the object of the process is to introduce oxygen to the liquid so that the micro-organisms contained therein can use this oxygen to digest the waste. The gas is commonly introduced by means of sparge pipes into a tank containing liquid and/or use of a surface aerator such as an impeller.

Surface aerators function both to stir and agitate the liquid while imparting energy onto the liquid, causing turbulence on the liquid surface along with causing the liquid to splash. As a result of the splashing and the turbulence of the liquid, the liquid is contacted by air and the liquid is thereby aerated.

During waste treatment process, the gas is initially introduced to the liquid, and after a period of time, the micro-organisms will have effected sufficient reaction for clear and/or treated liquid to be run off, possibly after a settling stage.

One disadvantage with these processes is that they are very inefficient. The length of time required to effect the reaction can be as long as 24 hours. This time period, combined with the fact that these waste treatment processes are oftentimes carried out continuously year round, provide a process that is very inefficient in terms of both time consumption and energy consumption.

In addition, oftentimes the impeller or surface aerator of waste treatment apparatuses are operated at such high power levels that the turbulence and the spray of the liquid is so great that liquid impacts or hits the mixing vessel walls at high velocities. As a result of these high velocity impacts, the liquid spray loses some of its kinetic energy, imparting some of its energy on the walls instead of the liquid surface. As a result of this loss of energy, less liquid surface turbulence occurs causing less aerating of the liquid. In addition, when the surface aerator is being operated at the previously mentioned high power levels, it tends to pump and spray water so fast that it essentially "starves" itself because the return liquid is not provided to the surface aerator as quickly as the aerator is pumping and discharging the liquid.

Also, as more energy is inputted into the surface of the liquid, the liquid located near the surface becomes increasingly more aerated, causing the density of the surface liquid to become significantly reduced. As a result, the low density liquid imparts a greater load on the impeller of the mixing system as the system attempts to pull the bubbles and aerated liquid into the depths of the mixing vessel. This greater load reduces the liquid flow of the mixing vessel, reducing mass transfer.

The aforementioned reduction in mass transfer also negatively affects the bottom velocities of the mixing vessel, which are utilized to suspend solids in the tank and are instrumental to obtaining a thoroughly, agitated mixture.

Current mixing apparatuses attempt to address the above described occurrences include employing a second mixing impeller. Oftentimes the second impeller is positioned near the bottom of the mixing vessel to assist in drawing the low density surface liquid downward and to increase bottom velocities. This arrangement oftentimes does not work, because it creates two flow patterns within the vessel and cuts down the magnitude of the liquid flow in the bottom of the mixing vessel.

Accordingly, it is desirable to provide an improved aeration apparatus for effectuating the energy efficient dispersement or transfer gas or other fluids into a liquid or liquid suspension in mixing systems. It is also desirable to provide efficient mass transfer while not compromising the bottom velocities of the mixing vessel or causing the liquid flow pattern within the vessel to be disrupted.

SUMMARY OF THE INVENTION

The foregoing needs are met, at least in part, by the present invention where, in one aspect, an improved mixing vessel for mixing and aerating a liquid or liquid suspension is provided. The improved mixing vessel includes at least one side wall and a bottom wall. The mixing apparatus also has a first reflector attached to the at least one side wall. The reflector is positioned at a first angle to the side wall.

In accordance with another aspect of the present invention, an improved mixing apparatus is provided having a vessel and a shaft. The mixing apparatus additionally includes a first impeller having a first diameter attached to the shaft and a second impeller having a second diameter attached to the shaft. The first impeller and second impeller are positioned a distance. This distance is equal to between approximately 0.20 to approximately 0.75 of the first diameter.

In accordance with another aspect of the present invention, an improved mixing vessel for mixing and aerating a liquid or liquid suspension is provided. The improved mixing vessel has at least one side wall and a bottom wall along with at least one reflector. The reflector is attached to the at least on side wall and/or bottom wall and the reflector is positioned at an angle to the bottom wall.

In accordance with still another aspect of the present invention, a method for aerating a liquid is provided, comprising agitating a liquid to form a spray in a vessel having at least one side and a bottom wherein the spray contacts the side; and deflecting the spray from the at least one side at an angle in the direction of the bottom of the vessel.

In accordance with yet another aspect of the present invention, an improved mixing apparatus is provided having means for containing a liquid or liquid suspension having at least one side and a bottom. The mixing apparatus also includes a means for agitating a liquid to form a spray that contacts the at least one side of the containing means along with a means for deflecting the spray from the at least one side at an angle in the direction of the bottom of the containing means.

There has thus been outlined, rather broadly, several features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

The present invention provides an apparatus and method for efficient mass transfer of gas or other fluids into a liquid and/or liquid suspension. The apparatus and method are preferably used in conjunction with waste treatment processes, bio-reactions and/or fermentation processes. In such arrangements, the apparatus and method is utilized to contact oxygen or another gas to liquid in a mixing vessel. This process is often referred to as pounds of oxygen or another gas per hour transferred to the liquid per horsepower or the Standard Aeration Efficiency (SAE) which is equal to the Standard Oxygen Transfer Rate (SOTR) divided by the shaft horsepower. It should be understood, however, that the present invention is not limited in its application to waste treatment or bio-reactions, but, for example, can be used with other processes requiring efficient gas-liquid contact.

Figure 1:
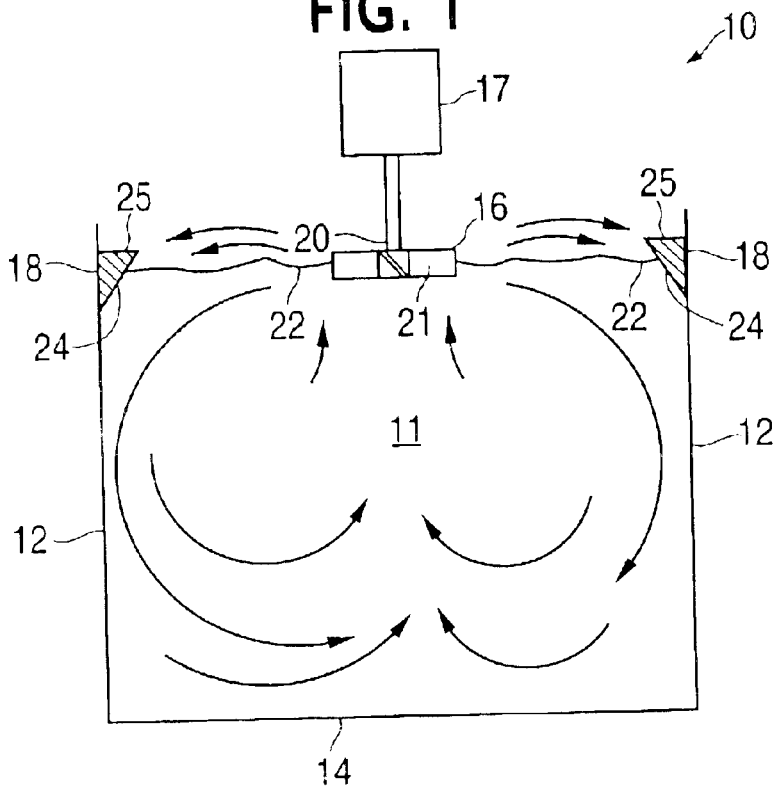
FIG. 1 is a side view of an improved aeration mixing apparatus in accordance with an embodiment of the present invention.

Referring now to the figures, wherein like reference numerals indicate like elements, FIGS. 1-4 depict improved aeration mixing apparatuses in accordance with embodiments of the present invention. Referring now to FIG. 1, an improved aeration mixing apparatus is illustrated, generally designated 10 having a generally square or rectangular mixing vessel 11. The mixing vessel has four side 12 and a bottom wall 14, but for descriptive purposes, only two of the side walls 12 will be described in detail. The mixing apparatus 10 also has a surface aerator 16 driven by drive means such as a motor 17, and two upper spray reflectors 18.

The surface aerator 16 depicted in FIG. 1 is connected to the motor 17 via a shaft 20 and can be either a radial flow impeller, pitched blade turbine or any standard aerator commonly utilized in the art. The blades 21 can be flat, rectangular plates or curved in shape and are usually pitched at an angle to the static level of the liquid surface, generally designated 22. The impeller 16 is preferably located close to the static level of the liquid surface 22, and a small portion of the width of the blade may project up through the surface 22.

As depicted in FIG. 1, the upper reflectors 18 are positioned on the side walls 12 so that they extend along the entire perimeter of the mixing vessel 11. The reflectors 18 are positioned at an angle to the side walls 12 such that the reflectors 18 have an upper portion positioned above the static liquid level 22 (out of the liquid) and a lower portion positioned below the static liquid level 22 (within the liquid). The reflectors 18 preferably extend the entire lengths of the side walls 12, and preferably have a single, planar surface 24 for reflecting liquid and liquid spray propelled from the aerator 16. Alternatively, the reflectors 18 may not extend the entire lengths of the side walls 12 and may extend only partially along the perimeter of the mixing vessel 11.

The reflectors 18 are preferably plates fastened to the side walls 12 via fasteners at an angle to the side walls 12 so that the liquid and/or spray propelled from the aerator 16, impacts the walls 12 at an angle generally less than 90°. Preferably, the reflectors 18 are positioned at an angle approximately 25° to approximately 65° to the side walls 12. More preferably, the reflectors 18 are positioned at a 45° to the side walls 12 and define an interior space between the side walls 12 and the reflectors 18.

As depicted in FIG. 1, the reflectors 18 in the embodiments herein described include top portions 25, that extend from the planar surfaces 24 to the side walls 12 that help to prevent liquid from being trapped in the interior space between the reflectors 18 and the side walls 12. Alternatively, reflectors 18 without top potions can also be employed in mixing vessels.

The reflectors 18 may be fastened to the side walls 12 via bolt, weld, bracket and/or any other fastening means known in the art. In addition, the reflectors 18 may be manufactured from various materials depending upon the application, such as metals, metal alloys, plastics, wood and synthetic fibers.

Alternatively, the reflectors 18 may be three-dimensional inserts and/or wedges and/or solids and have surfaces that are contoured or rounded in shape. In addition, the reflectors 18 may contain a series of reflective surfaces for reflecting the liquid. Also, the reflectors 18 can be integral with the side walls 12 of the vessel 10.

Figure 2:
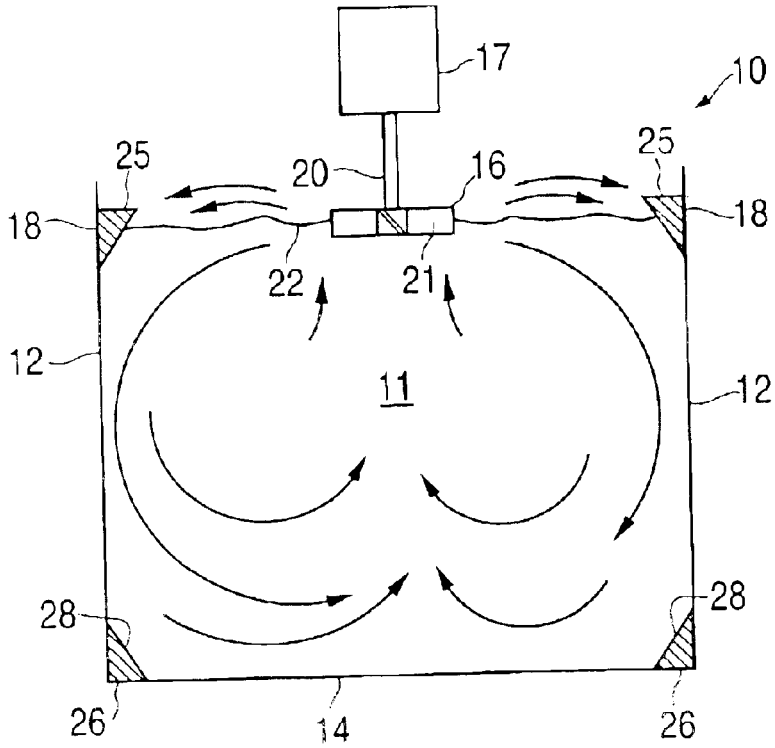
FIG. 2 is a side view of an improved aeration mixing apparatus in accordance with another embodiment of the present invention.

Referring now to FIG. 2, an alternative embodiment of the aeration mixing apparatus 10 illustrated in FIG. 1 is depicted having lower reflectors, generally designated 26, which are utilized in combination with the upper reflectors 18.

The lower reflectors 26 are positioned at the bottom of the vessel 10 and extend between the bottom wall 14 and the side walls 12. The reflectors 26 preferably have a single, planar surface 28 for directing the flow of the liquid as it travels along the side walls 12, as indicated by the arrows. The reflectors 26 are plates fastened to both the side walls 12 and bottom wall 14 via fasteners so that the reflectors 26 define an interior space. They may be alternatively be singularly fastened to either the side walls 12 or the bottom wall 14. The reflectors are positioned at an angle to the bottom wall 14 that is approximately 35° to approximately 70°. More preferably, the reflectors 26 are positioned at an angle to the bottom wall equal to 45°.

The reflectors 26 may be fastened to the side walls 12 and bottom wall 14 via bolt, weld, bracket and/or any other fastening means known in the art. The reflectors 26 can be manufactured from various materials depending upon the application, such as metals, metal alloys, plastics, wood and synthetic fibers.

Alternatively, the reflectors 26 may be three-dimensional inserts or wedges and/or solids and have surfaces that are contoured or rounded in shape. In addition, the reflectors 26 may contain a series of reflective surfaces for directing the liquid. Also, the reflectors 18 can be integral with the vessel 10.

Figure 3:
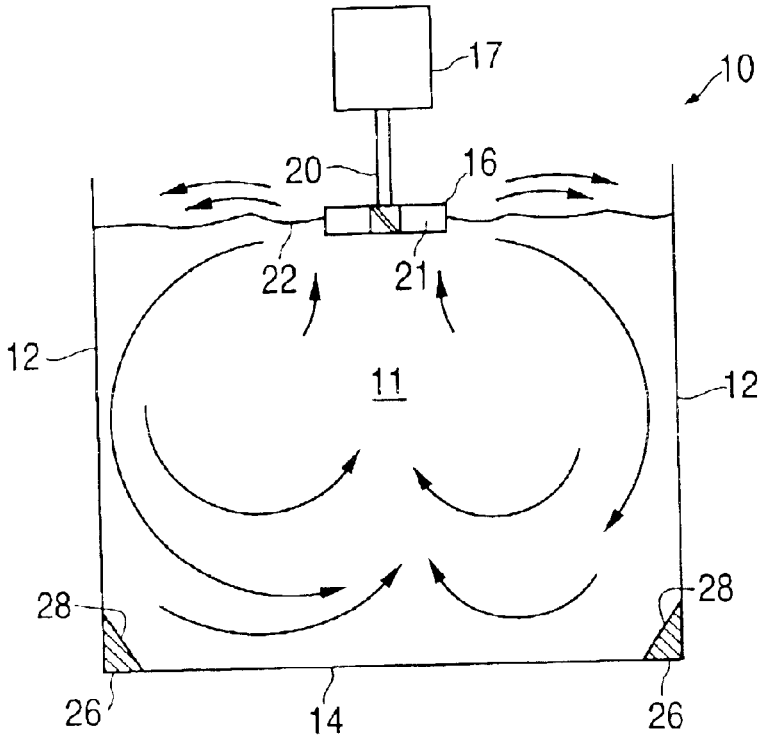
FIG. 3 is a side view of an improved aeration mixing apparatus in accordance with yet another embodiment of the present invention.

Referring now to FIG. 3, another alternative embodiment of the aeration mixing apparatuses 10 illustrated in FIGS. 1 and 2 is depicted having lower reflectors 26 only. As previously described, the lower reflectors 26 are positioned at the bottom of the vessel 10 and extend between the bottom wall 14 and the side walls 12 to define an interior space. The reflectors 26 preferably have a single, planar surface 28 for directing the flow of the liquid as it travels along the side walls 12, as indicated by the arrows. The reflectors 26 are preferably plates fastened to both the walls 12 and bottom wall 14 via fasteners. They may be alternatively be singularly fastened to either the side walls 12 or the bottom wall 14. The reflectors are positioned at an angle to the bottom wall 14 that is approximately 35° to approximately 70°. More preferably, the reflectors 26 are positioned at an angle to the bottom wall equal to 45°.

The mixing vessels 11 depicted in FIGS. 1–4 may also be circular or round in shape wherein they have a circumference. In such embodiments, the upper reflectors 18 and lower reflectors 26, can extend along the entire circumference of the mixing vessel, in the same manner described above. Alternatively, the reflectors 18 may only extend partially along the circumference.

During operation, the surface aerator 16 is driven by the motor 17 via the shaft 20. As a result, the aerator 16 sprays and/or scoops the liquid contained in the vessel 11, creating air bubbles. As the liquid is being scooped, it is also being discharged and/or sprayed radially across the surface of the tank, aerating the liquid. As the liquid is radially sprayed from the aerator 16, it contacts the surfaces 24 of the reflectors 18. As the upper reflectors 18 are contacted by the liquid, as depicted in both FIGS. 1 and 2, they function to direct and/or reflect the flow and spray of the liquid at an angle that is preferably less than 90°. This reflection and/or deflection by the reflectors 18 reduces the likelihood of a loss of kinetic energy by the aerated liquid and improves the flow of the liquid through the vessel 11.

Furthermore, the lower reflectors 26, as illustrated in the embodiments depicted in FIGS. 2 and 3, function to improve the circulation and the flow of the liquid in the vessel 11. As a result of the aforementioned increased flow, air bubbles are more easily drawn down further into the vessel 11, increasing liquid aeration.

Figure 4:
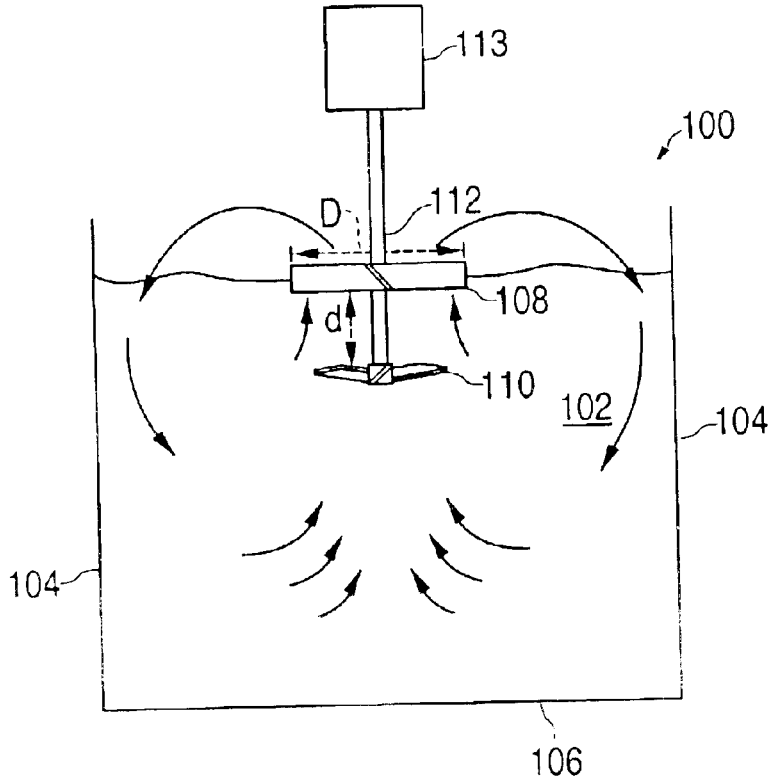
FIG. 4 is a side view of an improved aeration mixing apparatus in accordance with an embodiment of the present invention.

Referring now to FIG. 4, an improved aeration mixing apparatus 100 in accordance with an alternative embodiment of the present invention is depicted. The apparatus 100 includes a mixing vessel 102 having a four side walls 104, but for descriptive purposes, only two of the side walls 102 will be described herein in detail, and a bottom wall 106. The apparatus 100 also includes a first, upper impeller 108 connected to a second, lower impeller 110 via a shaft 112, and a drive means 113, such as a motor.

The first impeller 108 is preferably a standard surface aerator commonly employed in the art, having a diameter (D). The second impeller 110 is preferably a standard axial flow impeller commonly employed in the art, positioned along the shaft 112 a distance (d) from the first impeller 108. The first impeller 108 and the second impeller 110 are preferably spaced at a distance (d) apart from each other equal to approximately 0.2 to approximately 0.75 the diameter (D) of the aerator 108. Alternatively, this distance may vary depending upon mixing vessel size and can be greater than 0.75 the diameter (D) or less than 0.2 the diameter (D).

During operation, the shaft 112 is rotated via the motor 113 and the impellers 108, 110 rotate simultaneously. The surface aerator 108 functions to agitate and aerate the liquid by creating air bubbles within the liquid and by pushing and spraying the liquid radially. The lower impeller 110 functions to assist in the flow of the liquid within the vessel 102 and through the aerator, by assisting to provide a predominantly, single, upward liquid flow that enters the surface aerator 108. Furthermore, the lower impeller 110 functions to maintain or increase liquid flow bottom velocities in the vessel 102, and assists in drawing the air bubbles created by the aerator 108 into the depths of the vessel 102. As a result, flow within the vessel 102 and through the aerator 108 is increased, increasing aeration while only slightly increasing the required power output needed to operate the apparatus 100.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An improved mixing vessel having a static liquid level for mixing and/or aerating a liquid or liquid suspension, comprising:

at least one side wall and a bottom wall; and a first reflector, having an upper portion and a lower portion, attached to said at least one side wall, wherein said first reflector is positioned at a first angle to said at least one side wall, and wherein said upper portion of said first reflector is positioned above the static liquid level of the mixing vessel;

a second reflector attached to said bottom wall and said at least one side wall, wherein said second reflector is positioned at a second angle to said bottom wall.

2. The improved mixing vessel according to claim 1, wherein said first angle is equal to approximately 35° to approximately 70°.

3. The improved mixing vessel according to claim 2, wherein said first angle is 45°.

4. The improved mixing vessel according to claim 1, wherein said first reflector is a plate attached to said at least one side wall via a fastening means.

5. The improved mixing vessel according to claim 4, wherein said plate is contoured and/or concave in shape.

6. The improved mixing vessel according to claim 4, wherein said fastening means is bolt, screw and/or weld attachment.

7. The improved mixing vessel according to claim 4, wherein said plate is manufactured from metal, metal alloy, plastic and/or synthetic materials.

8. The improved mixing apparatus according to claim 1, wherein said second angle is equal to approximately 35° to approximately 70°.

9. The improved mixing apparatus according to claim 8, wherein said second angle is 45°.

10. The improved mixing apparatus according to claim 1, wherein said side wall has a generally circular shape and circumference wherein said first reflector extends along entire said circumference.

11. An improved mixing apparatus having a static liquid level, comprising:

a vessel having at least one side wall and a bottom wall;

a first reflector, having an upper portion and a lower portion, attached to said at least one side wall, wherein said first reflector is positioned at a first angle to said at least one side wall, and wherein said upper portion of said first reflector is positioned above the static liquid level of the mixing vessel;

a second reflector attached to said bottom wall and said at least one side wall, wherein said second reflector is positioned at a second angle to said bottom wall;

a shaft;

a first impeller having a first diameter attached to said shaft; and a second impeller having a second diameter attached to said shaft, wherein said first impeller and said second impeller are positioned a distance apart.

12. The improved mixing apparatus according to claim 11, wherein said distance is equal to between approximately 0.20 to approximately 0.75 of the first diameter.

13. The improved mixing apparatus according to claim 11, wherein said first impeller is a surface aerator.

14. The improved mixing apparatus according to claim 11, wherein said second impeller is a axial flow impeller.

15. A method for aerating a liquid having a static liquid level, comprising:

agitating a liquid to form a spray in a vessel having at least one side and a bottom, wherein the spray contacts the side; and deflecting the spray from the at least one side at an angle in the direction of the bottom of the vessel, wherein said vessel comprises a first reflector, having an upper portion and a lower portion, attached to said at least one side wall, wherein said first reflector is positioned at a first angle to said at least one side wall, and wherein said upper portion of said first reflector is positioned above the static liquid level of the mixing vessel; and a second reflector attached to said bottom wall and said at least one side wall, wherein said second reflector is positioned at a second angle to said bottom wall.

16. The method according to claim 15, wherein the spray is deflected at angle less than 90°.

17. An improved mixing apparatus having a static liquid level, comprising:

means for containing a liquid or liquid suspension having at least one side and a bottom;

means for agitating a liquid to form a spray that contacts the at least one side of the containing means; and means for deflecting the spray from the at least one side at an angle in the direction of the bottom of the containing means, wherein said means for containing comprises a first reflector, having an upper portion and a lower portion, attached to said at least one side wall, wherein said first reflector is positioned at a first angle to said at least one side wall, and wherein said upper portion of said first reflector is positioned above the static liquid level of the means for containing; and a second reflector attached to said bottom wall and said at least one side wall, wherein said second reflector is positioned at a second angle to said bottom wall.

* * * * *